US008845087B1

(12) United States Patent
Boland et al.

(10) Patent No.: US 8,845,087 B1
(45) Date of Patent: Sep. 30, 2014

(54) DYNAMIC DRYING OF PRINT MEDIA IN A RADIANT DRYER

(71) Applicants: Stuart J. Boland, Denver, CO (US); Sean K. Fitzsimons, Thornton, CO (US); Scott Johnson, Erie, CO (US); William Edward Manchester, Erie, CO (US); Casey E. Walker, Boulder, CO (US)

(72) Inventors: Stuart J. Boland, Denver, CO (US); Sean K. Fitzsimons, Thornton, CO (US); Scott Johnson, Erie, CO (US); William Edward Manchester, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 5 days.

(21) Appl. No.: 13/789,170

(22) Filed: Mar. 7, 2013

(51) Int. Cl.
*B41J 2/01* (2006.01)
*B41J 11/00* (2006.01)

(52) U.S. Cl.
CPC ..... *B41J 11/0015* (2013.01)
USPC ..... 347/102

(58) Field of Classification Search
CPC .... B41J 11/002; B41J 29/377; B41J 11/0015; B41J 2002/031
USPC ..... 347/16, 17, 101, 102, 104
See application file for complete search history.

(56) References Cited

U.S. PATENT DOCUMENTS

| | | | | |
|---|---|---|---|---|
| 7,210,775 | B2 * | 5/2007 | Hoshino | 347/102 |
| 8,474,968 | B2 * | 7/2013 | Yamaguchi | 347/102 |
| 8,672,469 | B1 * | 3/2014 | Walker et al. | 347/102 |

* cited by examiner

*Primary Examiner* — An Do
(74) *Attorney, Agent, or Firm* — Duft Bornsen & Fettig LLP

(57) ABSTRACT

Systems and methods provide dynamic radiant drying for a print media by monitoring a temperature of a test patch of colorant during the drying process. One embodiment is a radiant dryer and a control system. The radiant dryer receives a media marked with a wet colorant that depicts a sheetside of print data and a test patch. The radiant dryer includes a radiant energy source that heats the colorant based on a heating power. The radiant dryer further includes a cooling system within the interior that applies a cooling gas to the medium. The control system obtains a temperature of the test patch, determines a difference between the temperature of the test patch and a target temperature, and varies the heating power and/or an application of the cooling gas based on the difference to normalize temperatures across the medium during a drying process.

18 Claims, 5 Drawing Sheets

DYNAMIC DRYING OF PRINT MEDIA IN A RADIANT DRYER

FIELD OF THE INVENTION

The invention relates to the field of printing systems, and in particular, to radiant drying of print medium.

BACKGROUND

Businesses or other entities having a need for volume printing typically purchase a production printer. A production printer is a high-speed printer used for volume printing, such as 100 pages per minute or more. The production printers are typically continuous-form printers that print on paper or some other printable medium that is stored on large rolls.

A production printer typically includes a localized print controller that controls the overall operation of the printing system, a print engine (sometimes referred to as an "imaging engine" or as a "marking engine"), and a dryer. The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge colorants as controlled by the printhead controller. The printhead array is formed from multiple printheads that are spaced in series along a particular width so that printing may occur across the width of the medium. The dryer is used to heat the medium and colorant to dry the colorant. In some printing systems, the dryer is a radiant dryer, and may include a number of lamps or emitters that radiate infra-red energy to heat the medium and/or colorant.

In radiant dryers that apply a great deal of heat over a short period of time, it remains a problem to ensure that the medium is properly dried. Too much heat can cause the medium to char or burn. At the same time, too little heat can result in the colorant on the medium remaining wet, resulting in smearing or offsetting that reduces the print quality of jobs. Further, large variations in temperatures across the medium can arise during the drying process due to the varying densities of the colorants applied to the medium and variations in the energy absorption characteristics of the colorants.

SUMMARY

Embodiments described herein provide dynamic radiant drying for a print media by monitoring a temperature of a test patch of colorant during radiant drying. The test patch is printed in a margin of the web, and acts as a proxy for the temperature of the colorant used to mark the print data to the web. If the temperature of the test patch varies from a target temperature, then a heating power for drying the media is varied and/or a cooling gas applied to the media is varied.

One embodiment is an apparatus that includes a radiant dryer and a control system. The radiant dryer is operable to receive a continuous-form print medium marked with a wet colorant that depicts a sheetside of print data and a test patch. The radian dryer includes a radiant energy source within an interior of the dryer that is operable to heat the colorant based on a heating power to affix the colorant to the medium. The radiant dryer further includes a cooling system within the interior that is operable to apply a cooling gas to the medium. The control system is operable to obtain a temperature of the test patch, to determine a difference between the temperature of the test patch and a target temperature, and to vary at least one parameter selected from the heating power and an application of the cooling gas based on the difference to normalize temperatures across the medium during a drying process.

Another embodiment is a method for dynamic drying of a print media in an exemplary embodiment. The method comprises receiving a continuous-form media marked with a wet colorant that depicts a sheetside of print data and a test patch. The method further comprises heating the colorant based on a heating power to affix the colorant to the medium. The method further comprises applying a cooling gas to the medium, and obtaining a temperature of the test patch. The method further comprises determining a difference between the temperature of the test patch and a target temperature, and varying at least one parameter selected from the heating power and an application of the cooling gas based on the difference to normalize temperatures across the medium during a drying process.

Another embodiment is a non-transitory computer readable medium embodying programmed instructions executable by a processor. The instructions are operable to direct the processor to receive a continuous-form medium marked with a wet colorant that depicts a sheetside of print data and a test patch. The instructions further direct the processor to heat the colorant based on a heating power to affix the colorant to the medium. The instructions further direct the processor to apply a cooling gas to the medium, and to obtain a temperature of the test patch. The instructions further direct the processor to determine a difference between the temperature of the test patch and a target temperature, and vary at least one parameter selected from the heating power and an application of the cooling gas based on the difference to normalize temperatures across the medium during a drying process.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
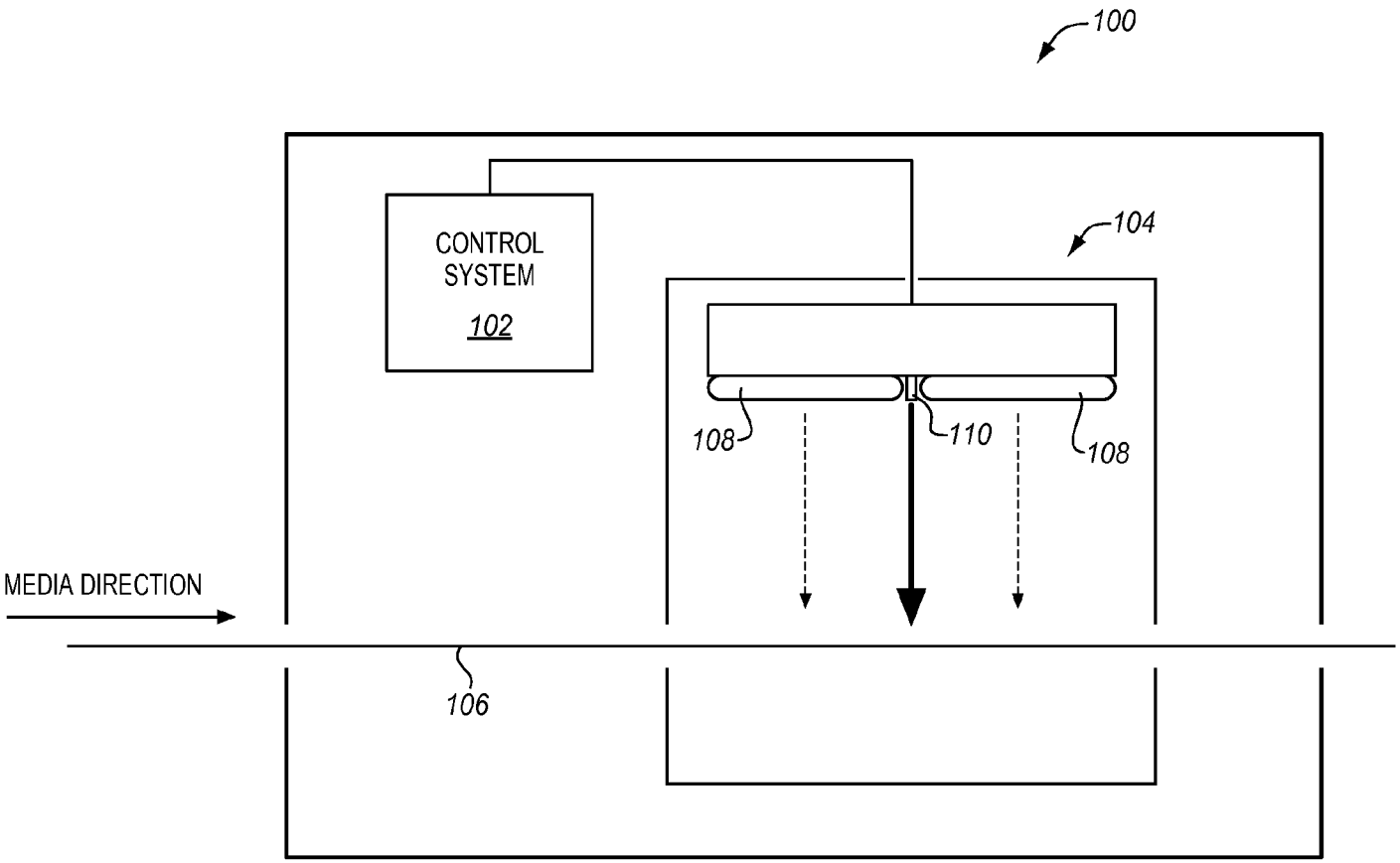
FIG. 1 is a block diagram of a printing system in an exemplary embodiment.

FIG. 1 is a block diagram of a printing system 100 in an exemplary embodiment. In this embodiment, printing system 100 includes a control system 102, and a radiant dryer 104. During operation, a web of print media 106 traverses a media path through printing system 100 in the direction indicated by the arrow in FIG. 1. During the printing process, media 106 travels along the media path proximate to a print engine (not shown) for marking with a wet colorant, such as aqueous inks. Media 106, now wet with the colorant, continues along the media path and has heat applied to media 106 by radiant dryer 104 to affix the colorant to media 106. Media 106 continues along the media path downstream of radiant dryer 104 where a number of post-processing activities may occur (e.g., cutting, stapling, folding, binding, mailing, etc.).

In this embodiment, radiant dryer 104 includes one or more radiant energy sources 108 that apply heat to media 106 and the applied colorant as media 106 traverses the interior of radiant dryer 104. Energy source 108 is typically a high power (e.g., 1-5 kilowatt) near infrared lamp or some other type of emission source that radiantly heats media 106 and the colorant(s) applied to media 106.

In this embodiment, radiant dryer 104 includes a cooling system 110 within the interior of radiant dryer 104. Cooling system 110 is able to apply a cooling gas (e.g., air) onto a media 106 using air jets, fans, etc. For instance, cooling system 110 may direct the cooling gas oriented in a line traversing the direction of travel of media 106, may be direct the cooling gas oriented in a line parallel to the direction of travel of media 106, etc.

One problem with prior printing systems is that hot spots arise on the web of print media during the drying process due to differences in colorant densities and/or the energy absorption rates of the colorants. For example, some sections of the web may have high colorant coverage and/or be marked with colorants that absorb more radiant energy during the drying process. This may cause problems in prior printing systems as some sections of the web may scorch while other sections of the web are not sufficiently dry. Further, the drying performance of prior art printing systems may change over time. For example, changes in humidity at the print shop, changes in temperature of the print shop, etc., may vary the drying quality and/or capabilities of prior printing systems. This makes consistent drying of the web difficult.

In this embodiment, control system 102 obtains the temperature of a test patch of colorant applied to media 106 along with a sheetside of print data, and determines a difference between the temperature of the test patch and a target temperature. The test patch is marked with a colorant used by printing system 100 in marking media 106 with print data, so the temperature of the test patch acts as a proxy for a temperature of the colorant used to print data for the job. Control system 102 then adjusts a heating power applied to source 108 and/or adjusts an application of a cooling gas directed to media 106 by system 110 based on the temperature difference between the test patch and the target temperature. This allows for an indirect temperature control of the colorant used to mark media 106 for print data for the job.

For example, in a CMYK printing system, the colorants used are Cyan, Magenta, Yellow, and Key black. Key black colorants, or other relatively high energy absorbing fluids, absorb more energy per unit time from energy source 108 than the other CMY colorants. Thus, a test patch of K colorant applied to media 106 may be measured, obtained, etc., and adjustments to the heat applied by source 108 and/or by the amount, rate, etc., of the cooling gas applied to media 106 is made. This reduces the large variations in temperatures due to localized heating of media 106 during the drying process, thus reducing the possibility of scorching media 106.

Consider an example whereby a print operator is tasked with printing a job at printing system 100, which has been enhanced to provide dynamic cooling of media 106 during the drying process. The print operator may specifically select printing system 100 based on the combination of colorants and print media specified in a job ticket for the print job, especially in cases where the combination is more prone to scorch or burn during the drying process. The print operator initiates printing of the job, which causes media 106 to traverse along a media path through printing system 100 in the direction indicated by the arrow in FIG. 1. A print engine (not shown) marks media 106 with a colorant based on the print data for the job and a test patch, and media 106 is directed along the media path into the interior of radiant dryer 104.

Figure 2:
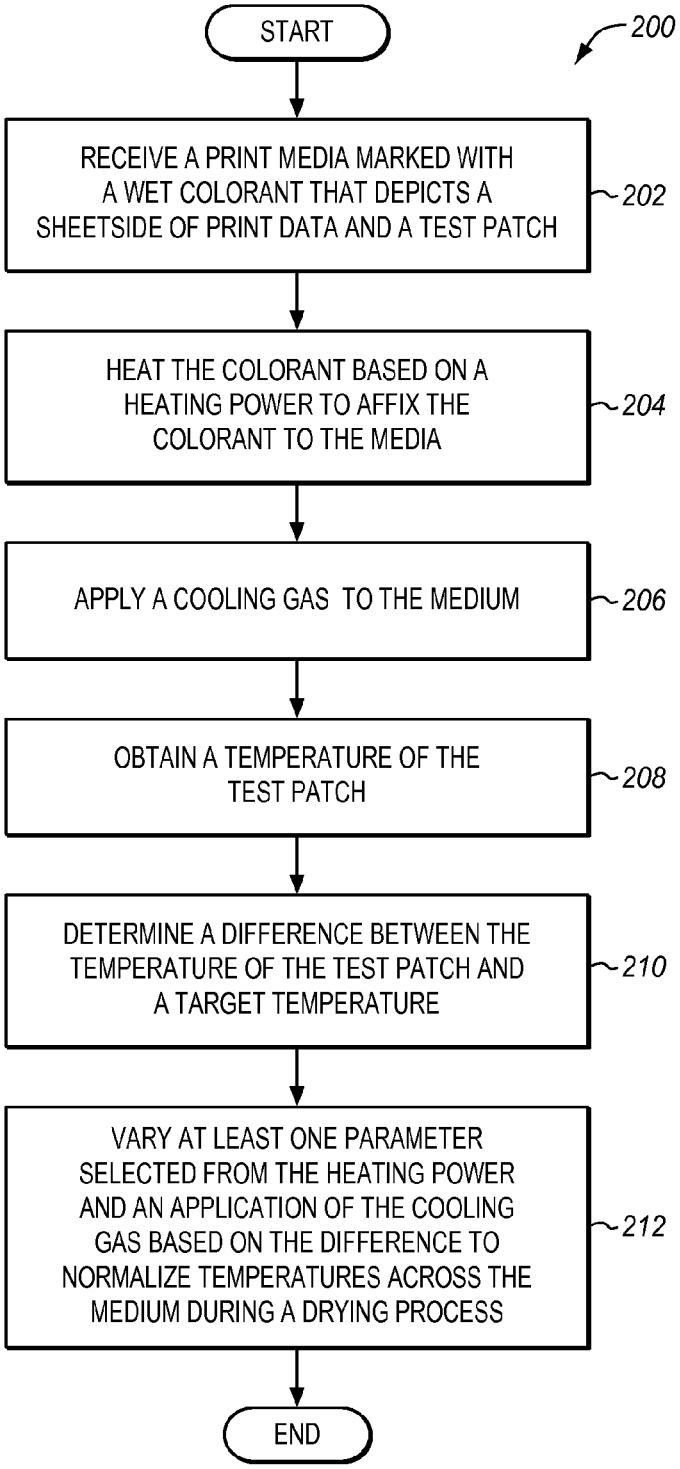
FIG. 2 is a flowchart illustrating a method for dynamic drying of a print media in an exemplary embodiment.

FIG. 2 is a flowchart illustrating a method for dynamic drying of a print media in an exemplary embodiment. The steps of method 200 will be described with reference to printing system 100 of FIG. 1, but those skilled in the art will appreciate that method 200 may be performed in other systems. The steps of the flowchart(s) described herein are not all inclusive and may include other steps not shown. The steps described herein may also be performed in an alternative order.

Figure 3:
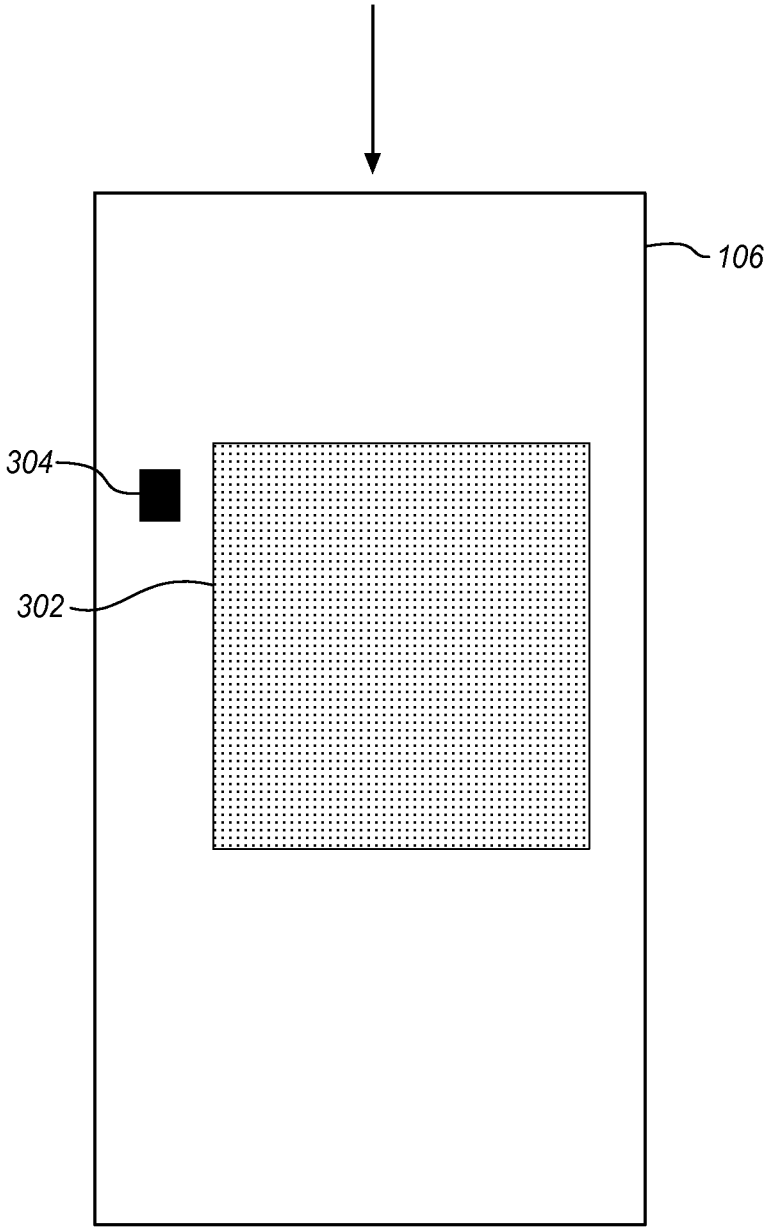
FIG. 3 is a block diagram of a print media including a sheetside of print data and a test patch in an exemplary embodiment.

In step 202, radiant dryer 104 receives print media 106 marked with a wet colorant that depicts a sheetside of print data and a test patch. FIG. 3 is a block diagram of print media 106 including a sheetside 302 of print data and a test patch 304 in an exemplary embodiment. In this embodiment, test patch 304 is printed alongside of sheetside 302 in a margin of media 106, although other configurations are possible. Generally sheetside 302 is one or more logical pages for a print job. Sheetside 302 may include any number of logical pages depending on the characteristics of the job. For instance, in a 4-up configuration, sheetside 302 includes 4 logical pages from a print job.

In step 204, energy source 108 heats the colorant based on a heating power to affix the colorant to media 106. During the drying process, the colorants and media 106 absorb energy from energy source 108 and begin to heat up. As the colorants heat, a carrier fluid (e.g., water) in the colorants vaporize. However, some colorants absorb more radiated energy per unit time from energy source 108 than other colorants. Thus, as media 106 traverses the interior of radiant dryer 104, the colorants applied to media 106 may dry at different rates.

In step 206, system 110 applies the cooling gas to media 106 to cool media 106 and/or the colorants applied to media 106 utilizing cooling system 110. The cooling gas generates air flow across media 106, which helps to remove the vaporized carrier fluids away from media 106. The cooling gas cools hot spots on media 106 and the colorants applied to media 106, preventing scorching of media 106. In step 208, control system 102 obtains a temperature of test patch 304. Obtaining the temperature of test patch 304 may be performed using a sensor (not shown) in a number of different ways. For instance, the sensor may be place in radiant dryer 104 such that test patch 304 travels proximate to the sensor as media 106 traverses the interior of dryer (e.g., the sensor is proximate to the marked side of media 106, is proximate to the opposite side of media 106, etc.). Further, the sensor may measure the temperature directly and/or may obtain the temperature though a proxy via measured humidity or some other method.

In step 210, control system 102 determines a difference between the temperature of test patch 304 and a target temperature. The target temperature may, for instance, reside within a range of acceptable temperatures for the colorant(s) of test patch 304. Further, different colorants may have different target temperatures as a matter of design choice. Generally, the target temperature is selected to ensure the adequate drying for the colorant. If the target temperature is too low, then the colorant may remain wet at the exit of radiant dryer 104. If the target temperature is too high, then the colorant may cause media 106 to scorch, burn, or catch fire. Further still, the target temperature may vary as a result of a speed of media 106, as a faster media 106 speed results in less time for drying to occur within radiant dryer 104. The target temperature may also vary based on the heating power applied to source 108 to dry the colorant. For instance, if high heating powers are used, then it may be desirable to reduce the target temperature for a colorant to reduce the risk of scorching media 106, burning media 106, etc., which may occur if the temperature of the colorant is near the top of an acceptable range of temperatures.

In step 212, control system 102 varies the heating power applied by source 108 and/or the application of the cooling gas by system 110 based on the temperature difference to normalize the temperatures across media 106. For instance, if the temperature of test patch 304 is below the target temperature, then control system 102 may increase the heating power applied to source 108 to increase the amount of heat applied to media 106 and/or the colorants applied to media 106. In like manner, if the temperature of test patch 304 is above the target temperature, then control system 102 may increase the application of the cooling gas provided by cooling system 110 to media 106 to improve the air flow at media 106, to remove the carrier fluids at a faster rate, to increase the heat loss from media 106 and/or the colorants applied to media 106, etc.

In system 100 of FIG. 1, test patch 304 acts as a temperature proxy for colorant(s) applied for sheetside 302 of print data during radiant drying. Thus, controlling the temperature of test patch 304 results in an indirect temperature control for corresponding colorant(s) applied to mark the print data to media 106. This allows for a more uniform temperature across media 106, which improves the drying quality of media 106, and reduces the possibility of scorching or burning media 106. Further, environmental changes for printing system 100 that would affect the drying ability or quality of prior printing systems, such as changes in humidity, changes in temperature, etc., are reduced and/or eliminated. This improves the drying quality of printing system 100.

Although only one test patch 304 is illustrated in FIG. 3, a plurality of patches may be utilized to represent a number of colorants, colorant densities, etc., in some embodiments. In such embodiments, the temperatures of the plurality of patches may be utilized by control system 102 to normalize the temperatures across media 106 by representing a wider variety of colorants that may have different radiant absorption characteristics, and/or a wider variety of colorant densities, which may heat at different rates.

Due to the high linear speed that media 106 traverses the interior of dryer 104, temperature control is not necessarily on a sheetside by sheetside basis. Rather, the patches may be included periodically along with the marked print data to allow control system 102 to normalize the temperatures across media 106 over time.

Example

Figure 4:
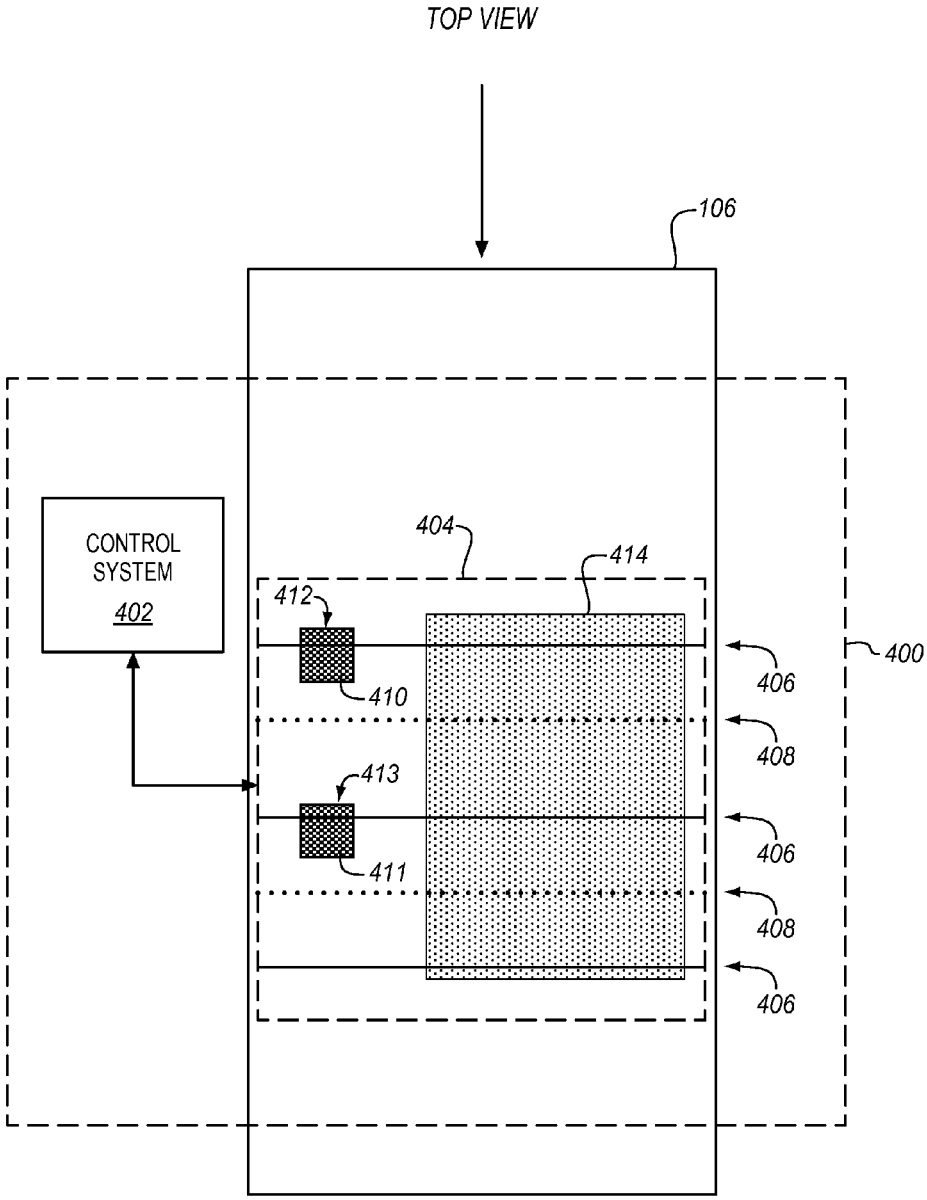
FIG. 4 is another printing system in an exemplary embodiment.

FIG. 4 is a block diagram of another printing system 400 in an exemplary embodiment. FIG. 4 illustrates a top view of printing system 400. In the example, printing system 400 includes a control system 402 and a radiant dryer 404. Radiant dryer 404 includes a plurality of radiant emitters 406 that traverse the interior of radiant dryer 404, as illustrated by the heavy black lines in FIG. 3. Radiant emitters 406 generate Infrared (IR), Near IR (NIR), etc., energy to radiantly heat media 106 and the colorants applied to media 106 as media 106 traverses the interior of radiant dryer 404. Radiant dryer 304 further includes a plurality of cool gas jets 408 that are distributed within the interior of radiant dryer 304. Systems 408 are illustrated as a plurality of dots in FIG. 4.

In FIG. 4, media 106 travels in the direction indicated by the arrow. During a printing process, a sheetside 414 of print data is marked to media 106 utilizing a plurality of colorants. Media 106 then travels into an interior of dryer 404 to undergo a drying process. In the example, a plurality of test patches 410-411 are included alongside of sheetside 414, and act as temperature proxies for colorants utilized in marking print data to media 106. Test patch 410 is marked with colorant 412, and test patch 411 is marked with colorant 413. For purposes of discussion, assume that colorants 412-413 have different radiant absorption characteristics. For example, colorant 412 may be Key black, while colorant 413 may be Magenta. Typically, Key black and Magenta absorb radiant energy at substantially different rates due to their different radiant absorption characteristics.

As media 106 travels through radiant dryer 404, heat is applied by emitters 406 and a cooling gas is applied by jets 408. As test patches 410-410 are marked with colorants that absorb radiant energy differently in the example, test patches 410-411 heat up at different rates, and therefore dry at different rates. Thus, test patches 410-411 may have temperatures that differ from each other during the drying process. Further, as test patches 410-411 act as temperature proxies for colorants used in marking sheetside 414 of print data to media 106, the corresponding colorants 412-413 in sheetside 414 also may have temperatures that differ from each other during the drying process. To ensure a more balanced temperature across media 106 during the drying process, control system 402 obtains the temperatures of test patches 410-411 and varies the heating power applied by emitters 406 and/or the cooling gas applied by jets 408 based on how the temperatures deviate from target temperature(s). In many cases, the temperatures will be different. For instance, test patch 410 may be below a range of acceptable temperatures for providing a high quality printed output, while test patch 411 may be near the top of the range of acceptable temperatures for providing a high quality printed output. Thus, control system 402 attempts to bring the temperatures of test patch 410, and indirectly, the corresponding colorant applied to sheetside 414, back within an acceptable range of temperature values. This acts to normalize the temperatures across media 106 during the drying process, thereby ensuring a high quality printed output.

As colorant 412 applied to test patch 410 is a proxy for the temperature(s) of colorant 412 applied to sheetside 414, having test patch 410 below the range of acceptable values is undesirable. Thus, control system 402 increases the heating power applied to emitters 406, which generate more radiant heat to dry the colorants through radiant absorption. Over time, colorant 412 applied to media 106, which indicated a lower than optimal temperature via test patch 410, absorbs energy at a higher rate and heats up. This may be sufficient to bring the colorant 412 applied to media 106 back within the acceptable range of temperatures. Control system 402 may, for instance, verify this is the case by obtaining the temperatures of upstream test patches (not shown) that utilize colorant 412, thus providing a more normalized temperature across media 106 during the drying process over time.

However, one response to an increase in the heating power applied to emitters 306 is that some colorants may heat up more than desired. For example, with test patch 411 near the top of the range of acceptable temperature values, increasing the heating power may push the temperature of patch 411 above the range. As colorant 413 applied to test patch 411 is a proxy for the temperature(s) of colorant 413 applied to sheetside 414, this is undesirable. Thus, control system 402 applies more cooling gas via jets 408 to media 106 to increase the heat removal rate for colorants on media 106.

Over time, colorant 413 applied to media 106, which indicated a higher than optimal temperature via test patch 411, loses energy at a higher rate and cools down. This may be sufficient to bring the colorant 413 applied to media 106 back within the acceptable range of temperatures. Control system 402 may, for instance, verify this is the case by obtaining the temperatures of upstream test patches (not shown) that utilize colorant 413, thus providing a more normalized temperature across media 106 during the drying process over time.

Figure 5:
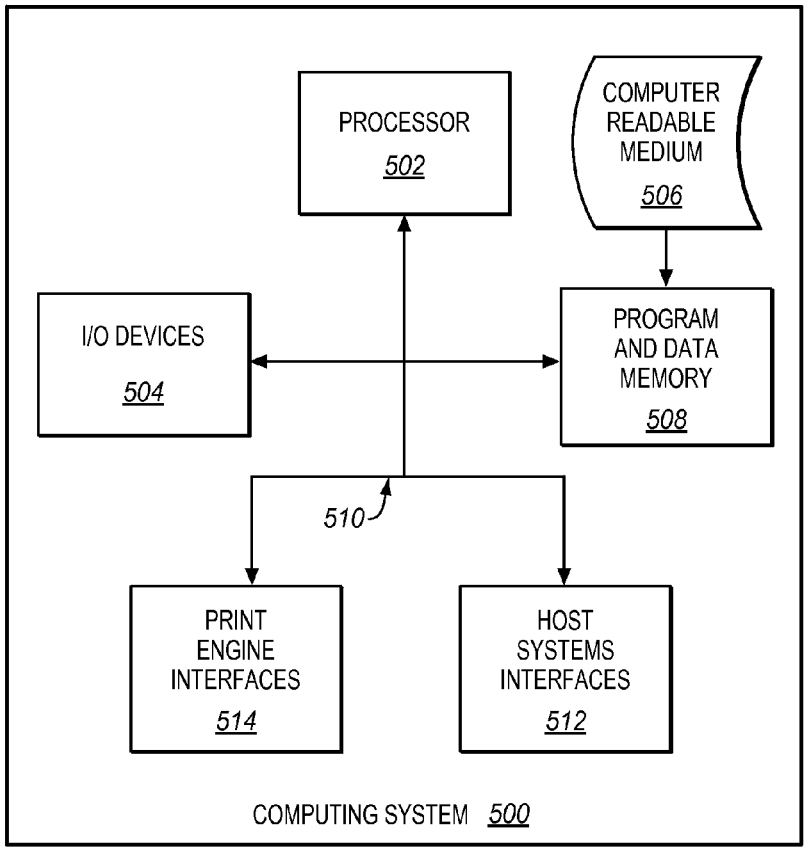
FIG. 5 illustrates a processing system operable to execute a computer readable medium embodying programmed instructions to perform desired functions in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 5 illustrates a computing system 500 in which a computer readable medium may provide instructions for performing the method of FIG. 2 in an exemplary embodiment.

Furthermore, the invention can take the form of a computer program product accessible from a computer-usable or computer-readable medium 506 providing program code for use by or in connection with a computer or any instruction execution system. For the purposes of this description, a computer-usable or computer readable medium 506 can be any apparatus that can contain, store, communicate, or transport the program for use by or in connection with the instruction execution system, apparatus, or device.

The medium 506 can be an electronic, magnetic, optical, electromagnetic, infrared, or semiconductor system (or apparatus or device) or a propagation medium. Examples of a computer-readable medium 506 include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include one or more processors 502 coupled directly or indirectly to memory 508 through a system bus 510. The memory 508 can include local memory employed during actual execution of the program code, bulk storage, and cache memories which provide temporary storage of at least some program code in order to reduce the number of times code is retrieved from bulk storage during execution.

Input/output or I/O devices 504 (including but not limited to keyboards, displays, pointing devices, etc.) can be coupled to the system either directly or through intervening I/O controllers.

Network adapters may also be coupled to the system to enable the data processing system to become coupled to other data processing systems, such a through host systems interfaces 512, or remote printers or storage devices through intervening private or public networks. Modems, cable modem and Ethernet cards are just a few of the currently available types of network adapters. System 500 further includes print engine interfaces 514.

Although specific embodiments were described herein, the scope of the invention is not limited to those specific embodiments. The scope of the invention is defined by the following claims and any equivalents thereof.

We claim:

1. An apparatus comprising:

a radiant dryer operable to receive a continuous-form print medium marked with a wet colorant that depicts a sheetside of print data and a test patch, the radiant dryer including:

a radiant energy source within an interior of the dryer that is operable to heat the colorant based on a heating power to affix the colorant to the medium; and a cooling system within the interior of the dryer that is operable to apply a cooling gas to the medium; and a control system operable to obtain a temperature of the test patch, to determine a difference between the temperature of the test patch and a target temperature, and to vary at least one parameter selected from the heating power and an application of the cooling gas based on the difference to normalize temperatures across the medium during a drying process.

2. The apparatus of claim 1 wherein:

the wet colorant depicts a plurality of test patches; and the control system is further operable to obtain temperatures of the plurality of test patches, to identify a first test patch having a temperature below the target temperature, and to increase the heating power to normalize the temperatures across the medium during the drying process.

3. The apparatus of claim 2 wherein:

the control system is further operable to identify a second test patch having a temperature above the target temperature, and to increase the application of the cooling gas to normalize the temperatures across the medium during the drying process.

4. The apparatus of claim 2 wherein:

the test patches are marked with a plurality of colorants that vary in radiant energy absorption characteristics.

5. The apparatus of claim 2 wherein:

the test patches are marked with the colorant at different densities.

6. The apparatus of claim 1 wherein:

the target temperature varies by a threshold amount.

7. A method comprising:

receiving a continuous-form medium marked with a wet colorant that depicts a sheetside of print data and a test patch.

heating the colorant based on a heating power to affix the colorant to the medium;

applying a cooling gas to the medium;

obtaining a temperature of the test patch;

determining a difference between the temperature of the test patch and a target temperature; and varying at least one parameter selected from the heating power and an application of the cooling gas based on the difference to normalize temperatures across the medium during a drying process.

8. The method of claim 7 wherein:

the wet colorant depicts a plurality of test patches;

obtaining the temperature further comprises:

obtaining temperatures of the plurality of test patches; and varying at least one parameter further comprises:

identifying a first test patch having a temperature below the target temperature; and increasing the heating power to normalize the temperatures across the medium during the drying process.

9. The method of claim 8 wherein:

varying at least one parameter further comprises:

identifying a second test patch having a temperature above the target temperature; and increasing the application of the cooling gas to normalize the temperatures across the medium during the drying process.

10. The method of claim 8 wherein:

the test patches are marked with a plurality of colorants that vary in radiant energy absorption characteristics.

11. The method of claim 8 wherein:

the test patches are marked with the colorant at different densities.

12. The method of claim 7 wherein:

the target temperature varies by a threshold amount.

13. A non-transitory computer readable medium embodying programmed instructions executable by a processor, the instructions operable to direct the processor to:

receive a continuous-form medium marked with a wet colorant that depicts a sheetside of print data and a test patch.

heat the colorant based on a heating power to affix the colorant to the medium;

apply a cooling gas to the medium;

obtain a temperature of the test patch;

determine a difference between the temperature of the test patch and a target temperature; and vary at least one parameter selected from the heating power and an application of the cooling gas based on the difference to normalize temperatures across the medium during a drying process.

14. The medium of claim 13 wherein:

the wet colorant depicts a plurality of test patches;

instructions to obtain the temperature further comprise instructions to:

obtain temperatures of the plurality of test patches; and instructions to vary at least one parameter further comprise instructions to:

identify a first test patch having a temperature below the target temperature; and increase the heating power to normalize the temperatures across the medium during the drying process.

15. The medium of claim 14 wherein:

instructions to vary at least one parameter further comprise instructions to:

identify a second test patch having a temperature above the target temperature; and increase the application of the cooling gas to normalize the temperatures across the medium during the drying process.

16. The medium of claim 14 wherein:

the test patches are marked with a plurality of colorants that vary in radiant energy absorption characteristics.

17. The medium of claim 14 wherein:

the test patches are marked with the colorant at different densities.

18. The medium of claim 14 wherein:

the target temperature varies by a threshold amount.

* * * * *